US009757939B2

(12) United States Patent
De Grijs

(10) Patent No.: US 9,757,939 B2
(45) Date of Patent: Sep. 12, 2017

(54) INK JET PRINTING METHOD AND PRINTER

(71) Applicant: OCE-TECHNOLOGIES B.V., Venlo (NL)

(72) Inventor: Eduard T. H. De Grijs, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/229,388

(22) Filed: Aug. 5, 2016

(65) Prior Publication Data

US 2016/0339689 A1 Nov. 24, 2016

Related U.S. Application Data

(63) Continuation of application No. PCT/EP2015/052095, filed on Feb. 2, 2015.

(30) Foreign Application Priority Data

Feb. 6, 2014 (EP) ..... 14154195

(51) Int. Cl.
*B41J 2/045* (2006.01)
*B41J 2/21* (2006.01)

(52) U.S. Cl.
CPC ..... *B41J 2/0451* (2013.01); *B41J 2/04586* (2013.01); *B41J 2/2139* (2013.01); *B41J 2/2142* (2013.01)

(58) Field of Classification Search
CPC .... B41J 2/0451; B41J 2/04586; B41J 2/0452; B41J 2/2139; B41J 2/2142
See application file for complete search history.

(56) References Cited

U.S. PATENT DOCUMENTS

2007/0046715 A1 3/2007 Yamanobe et al.
2011/0304665 A1 12/2011 Mantell
(Continued)

*Primary Examiner* — Jason Uhlenhake
(74) *Attorney, Agent, or Firm* — Birch, Stewart, Kolasch & Birch, LLP

(57) ABSTRACT

A method compensates a failing nozzle of a print head of an inkjet printer. The inkjet printer includes at least one print head, the at least one print head including a plurality of nozzles. A receiving material is moved relatively to the at least one print head. The method includes ejecting droplets of marking material from the plurality of nozzles onto the receiving material forming dots of an image, scanning the printed dots, analyzing the scanned dots for detecting whether a nozzle is failing, determining a group of nozzles, which group of nozzles most likely contains the nozzle that is failing, selecting one nozzle of the group of nozzles, in an image part ejecting compensating droplets of marking material in accordance with a compensation scheme selected as if the one nozzle is failing, scanning the image part, repeating the steps of ejecting and scanning for each other nozzle in the group of nozzles, analyzing each image part, selecting from the image parts a deviating image part, the deviating image part having a highest or lowest print quality of all image parts, selecting a compensation scheme based on the deviating image part, and proceeding with printing, including ejecting compensating droplets in accordance with the selected compensation scheme. An inkjet printer is configured to execute the method.

10 Claims, 9 Drawing Sheets

(56) References Cited

U.S. PATENT DOCUMENTS

| | | | | |
|---|---|---|---|---|
| 2012/0075370 | A1 | 3/2012 | Ramakrishnan et al. | |
| 2013/0222455 | A1 * | 8/2013 | Wu | B41J 2/04543 347/13 |

* cited by examiner

INK JET PRINTING METHOD AND PRINTER

CROSS-REFERENCE TO RELATED APPLICATIONS

This application is a Continuation of International Application No. PCT/EP2015/052095, filed on Feb. 2, 2015, and for which priority is claimed under 35 U.S.C. §120. PCT/EP2015/052095 claims priority under 35 U.S.C. §119(a) to application Ser. No. 14154195.3, filed in Europe on Feb. 6, 2014. The entire contents of each of the above-identified applications are hereby incorporated by reference into the present application.

BACKGROUND OF THE PRESENT INVENTION

1. Field of the Invention

The present invention relates to a method of compensating a failing nozzle of a print head of an inkjet printer, the inkjet printer comprising at least one print head, the at least one print head comprising a plurality of nozzles. A receiving material is moved relative to the at least one print head. The method comprises the steps of ejecting droplets of marking material from the plurality of nozzles onto the receiving material forming dots of an image, scanning the printed dots, and analyzing the scanned dots for detecting whether a nozzle is failing.

2. Description of Background Art

In inkjet printing, nozzle failures may be caused by nozzle clogging, contamination of a plate in which the nozzles are formed, events in which the nozzles are touched by the receiving material, misdirection of marking material from a nozzle and the like. Such nozzle failures are a serious threat to reliable ink jet printing and to print quality. Therefore it is necessary to avoid a nozzle failure and to detect a nozzle failure as soon as possible after the moment in time of failure of the nozzle.

In a single pass print process, the print head and the receiving material are moved relative to one another in such a manner that each location on the receiving material is exposed to the nozzles of the print head only once. When the width of the print head is at least as large as the width of the receiving material, the receiving material may be moved past the print head in a uniform direction, or, conversely, the print head may be moved over the receiving material only once. When the print head does not cover the entire width of the receiving material, it is moved in a main scanning direction across the paper so as to print one or more lines, and the paper is then advanced in a sub-scanning direction, so that another swath of the image will be printed in the next pass of the print head. Such a single pass process is particularly vulnerable to nozzle failures because there are only limited possibilities to compensate nozzle failures by printing extra dots with other, still intact nozzles of the print head.

Another approach to improve reliability in ink jet printing involves an automatic nozzle failure detection, which permits taking measures for removing the nozzle failure before a larger number of defective images are printed. For example, nozzle failure may be detected by printing a test pattern and then inspecting the test pattern from time to time. However, this method causes a waste in paper and marking material, especially when the test is repeated in short intervals. Moreover, this method requires a sheet disposal trajectory in the paper pass of the printer, so that the sheets carrying the test pattern may be disposed.

Another method of nozzle failure detection involves inspecting the image that has been printed in accordance with the print data. This is advantageous since a nozzle failure can be detected immediately, and the running print process may be stopped, if necessary. However, depending on the nature of the print data, it may be difficult to detect a specific nozzle that is failing from a scanned print.

Methods have been developed to identify failing nozzles using printed information. Such detection, which uses printed information, tries to identify failing nozzles by means of detecting certain stripes in the prints, by scanning all the prints on the fly with a high speed scanner. A problem which arises with such detection is that a nozzle failure can be detected, but not the exact nozzle number that has failed. Faults may be caused by, for instance, misalignment of the print heads, local nozzle side shooters, and scanner artefacts (aberrations). A scanner may be positioned anywhere along the print path for scanning prints that have been printed by the print head. Variations over time, like different coefficients of expansion, suction belt oscillations, nozzle side shooter variations, etc. make the allotment of a certain stripe to a specific nozzle number not possible with high certainty. Such a method is described in U.S. Application Publication No. 2013/0222455. A disadvantage of this method is that multiple incorrect images with serious print artefacts are printed until the exact nozzle number is identified and a correct nozzle compensation can be applied.

By various calibrations, the failing nozzle may be denoted within a few different nozzle numbers, but not the exact nozzle number. This is a problem, because if nozzle failure correction is used, the exact nozzle failure position must be known, otherwise the correction could cause the nozzle failure stripe to be worsened.

SUMMARY OF THE PRESENT INVENTION

It is an object of the present invention to compensate for a nozzle that is failing during printing.

This object is achieved by a method of compensating a failing nozzle of a print head of an inkjet printer, the inkjet printer comprising at least one print head, the at least one print head comprising a plurality of nozzles, wherein a receiving material is moved relative to the at least one print head, and wherein the method comprises the steps of ejecting droplets of marking material from the plurality of nozzles onto the receiving material forming dots of an image; scanning the printed dots; analyzing the scanned dots for detecting whether a nozzle is failing; determining a group of nozzles, which group most likely contains the nozzle that is failing; selecting one nozzle of the group of nozzles; in an image part, ejecting compensating droplets of marking material in accordance with a compensation scheme selected as if said one nozzle is failing; scanning the image part, repeating the steps of ejecting and scanning for each other nozzle in the group of nozzles; analyzing each image part, selecting from the image parts an improved image part, the improved part having a highest print quality of all image parts, and proceeding with printing, including ejecting compensating droplets in accordance with the compensation scheme used in the improved image part.

The present invention is based on varying the ejection of compensating droplets during printing of the image on the receiving medium. The image parts are scanned subsequently and there is always an image part having the highest print quality of all image parts. The print quality of each image part may be determined by any suitable image processing method for the image part, for example by averaging a lightness component, chroma component and/or hue component of the pixels of the image part. The compensation scheme used when that particular improved image part has been printed is the optimal compensation scheme for compensating the failing nozzle during printing of the rest of the image and further images. The present invention may not only be used for non-ejecting nozzles but also for all kind of failing nozzles like side shooters.

According to an embodiment, each image part has such a size in the direction of the movement of the receiving material, e.g. a size of six pixels, that variations in the printed dots on the image parts are not or are slightly visible to an observer, but are detectable when analyzing the image parts. This variation may be performed with a high frequency. For instance, droplets from another compensating nozzle are ejected every 6 pixels in the direction of the movement of the receiving material.

According to an embodiment, the method further comprises the step of repeating the ejection of compensating droplets for the image parts until printing is proceeded, including ejecting compensating droplets in accordance with the compensating scheme used in the improved image part. In this way, print artefacts in the image portion, which is printed between detection that a nozzle is failing and the proceeding of the printing according to the compensation scheme used in the improved image, are not or are slightly visible, since the failing nozzle is partly compensated by a compensating nozzle and variations of the compensating nozzles are applied continuously over the image parts.

According to a further embodiment, the method further comprises the step of selecting from all image parts a number of image parts having a low variation of print data, said number being sufficient for selecting the improved image part. This is advantageous, because image parts with a high variation in the print data like text areas, or with no variation in the print data like zero or full coverage areas are excluded from analyzing.

According to an embodiment, the method further comprises the step of identifying a nozzle uniquely corresponding to the improved image part as the failing nozzle. This is advantageous, since as the failing nozzle is known, the correction scheme may be varied upon in order to find the best correction possible for the specific nozzle that is failing. Even by varying the correction method and the amount of correction within the image on the already known failing nozzle, it is possible to improve the nozzle failure correction for the specific nozzle that is failing.

According to an embodiment, the method further comprises the step of ejecting regular droplets of marking material needed for the image from said one nozzle that is assumed to be failing, in addition to ejecting the compensating droplets.

The present invention also relates to an inkjet printer comprising: a print head having a plurality of nozzles, wherein a receiving material is moved relative to the print head and droplets of marking material are ejected from the nozzles onto the receiving material in order to form an image of dots on the receiving material; a scanner configured to scan printed dots; and a controller configured to schedule compensation schemes during printing of the image in order to apply the method according to the present invention.

The present invention also relates to a computer program embodied on a non-transitory computer readable medium and comprising computer program code to enable a reproduction apparatus in order to execute the method according to the present invention.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMEMTS

Figure 1:
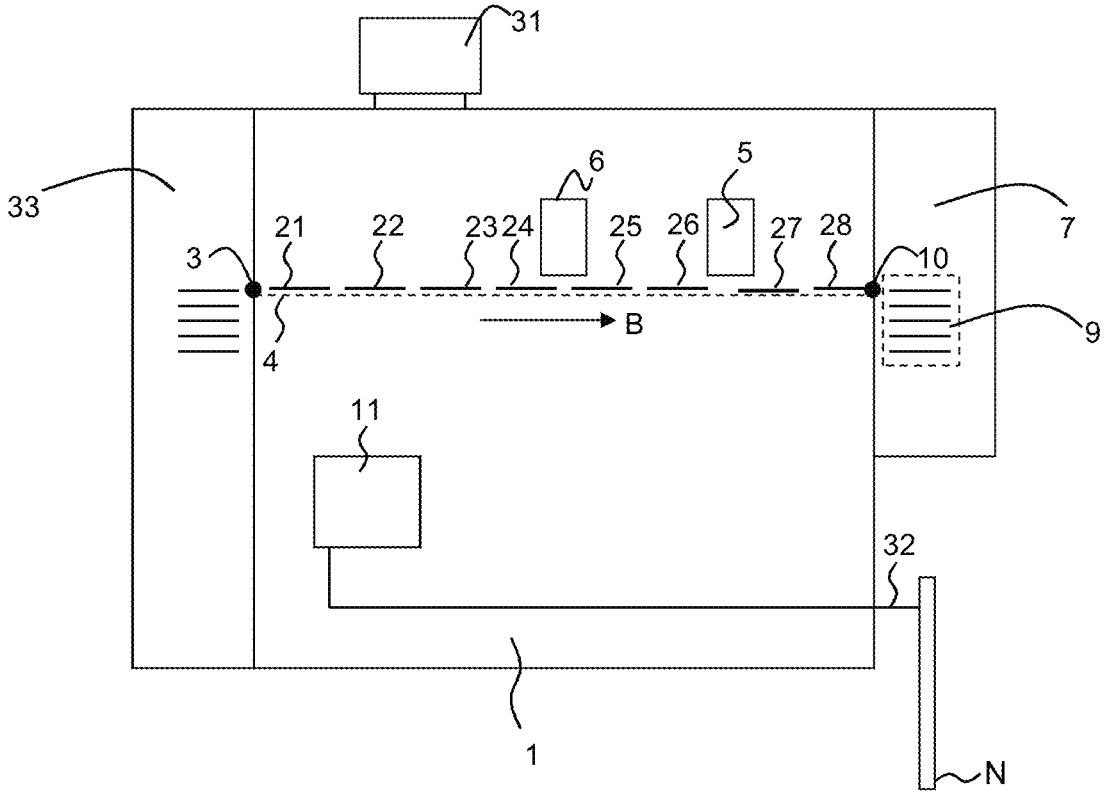
FIG. 1 is a schematic view of a reproduction apparatus to which the present invention is applicable.

The present invention will now be described with reference to the accompanying drawings, wherein the same reference numerals have been used to identify the same or similar elements throughout the several views.

FIG. 1 illustrates an inkjet printer with a print unit 6 having a size in a first direction A (not shown in FIG. 1) and a size in the transport direction B perpendicular to the first direction A. Small sheets 21-28 are transportable in the transport direction B. The inkjet printer 1 comprises a scan unit 5 for scanning analogue images printed on the receiving material 21-28. The inkjet printer 1 further comprises a mechanism configured to print jobs and optionally a mechanism configured to manipulate print jobs. These mechanisms may be digital input devices such as a user interface 31 and/or a controller 11, for example a computer placed inside the inkjet printer 1. The present invention may also be applied to a roll-to-roll printer or a roll-to-sheet printer. The controller 11 may also be placed in the neighborhood of the inkjet printer 1, wherein the controller 11 is connected to the inkjet printer 1 via a network cable or wireless connection.

The controller 11, for example a computer, comprises a processor adapted to issue commands to the inkjet printer, for example for controlling the print process and for applying nozzle failure detection and nozzle failure correction. The controller 11 is connected to the print unit 6 and the scan unit 5. The inkjet printer 1 may optionally be connected to a network N. The connection to the network N is diagrammatically shown in the form of a cable 32, but nevertheless, the connection could be wireless. The inkjet printer 1 may receive printing jobs via the network N. Further, optionally, the controller 11 may be provided with a USB port, so printing jobs may be sent to the inkjet printer 1 via this USB port.

Receiving material may be sheets or a web. FIG. 1 shows receiving material in the form of sheets 21-28. The sheets 21-28 may enter the inkjet printer 1 via an entry 3, to which an input unit 33 may be coupled. The input unit 33 may be any compatible sheet input module that is able to feed one sheet at a time to the inkjet printer 1. The inkjet printer 1 may also comprise a built-in input unit, for example a tray or a plurality of trays, for receiving sheets from outside the inkjet printer 1. An operator may fill these trays from outside the inkjet printer 1 or sheets may arrive from another device at the entry point 3.

Via a transport mechanism 4, indicated with a dashed line, the sheets 21-28 arrive at the print unit 6 in the transport direction B. The sheets are transported underneath the print unit 6. Droplets of marking material are ejected from the print unit 6 towards the sheets 21-28 in order to form an image on the sheets. The sheets are then transported underneath the scan unit 5 for scanning the printed images on the sheets. After passing the scan unit 5, the sheets 21-28 are transported to exit point 10. An output unit 7 may be coupled to the inkjet printer 1 for stacking the printed sheets 9.

Figure 2:
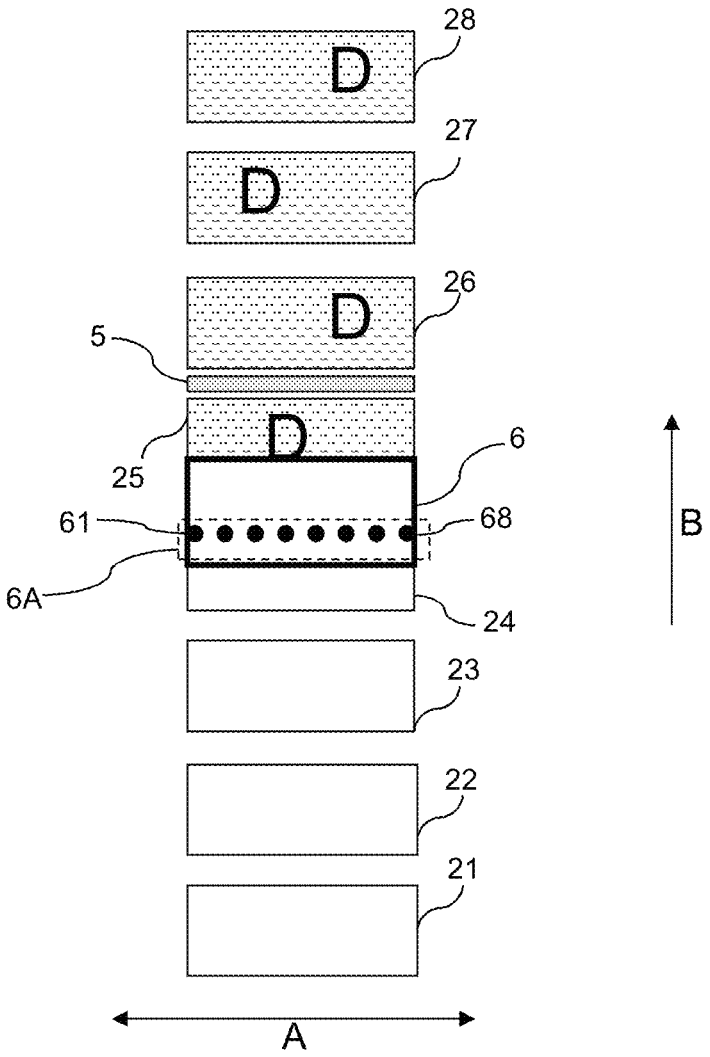
FIG. 2 is a schematic top view of the marking material path in the reproduction apparatus of FIG. 1.

FIG. 2 is a schematic top view of the inkjet printer between the entry point 3 and the exit point 10. In FIG. 2 a first sheet 21, a second sheet 22 and a third sheet 23 are transported in the transport direction B towards the print unit 6. A fourth sheet 24 is already partly beneath the print unit 6 ready to be printed upon. The print unit 6 comprises a print head 6A comprising a plurality of nozzles 61-68. For convenience reasons, eight nozzles are drawn and one print head is drawn. In practice, the amount of print heads in the first direction A and in the transport direction B, as well as the amount of nozzles per print head in the first direction A and the second direction B will be much larger. As shown in FIG. 2, the print head 6A consisting of nozzles 61-68 is able to eject marking material on the fourth sheet 24 from all nozzles 61-68. A fifth sheet 25 is leaving the print unit 6 in the transport direction B and is going to enter beneath the scan unit 5. The scan unit 5 may be any scan unit which is able to distinguish pixels of amounts of marking material ejected upon the receiving material of the sheets 21-28 with a resolution that is high enough to relate an amount of marking material to a group of nozzles, which group of nozzles has ejected the amount of marking material. As already mentioned, it is difficult to relate exactly one nozzle to a pixel amount on the receiving material. A sixth sheet 26, a seventh sheet 27 and an eighth sheet 28 have already left the scan unit 5 in the transport direction B.

In another embodiment of the inkjet printer 1 as shown in FIG. 1, the scan unit 5 is coupled to or integrated to the print head, such that printed receiving material can immediately be scanned.

An output mechanism 7 may be connected to exit 10 for further finishing of the sheets.

The controller 11 is connected to the print unit 6 in order to assign nozzles 61-68 to pixels of the digital image data, and to schedule in time the ejection of marking material from the assigned nozzles.

The controller 11 is connected to the scan unit 5 in order to detect droplets ejected on the receiving material which is underneath the scan unit 5.

The controller 11 is also connected to the print engine (not shown) and is configured to relate the detected droplets by the scan unit 5 to the part of the digital image data taking the print velocity and the distance between the print unit 6 and the scan unit 5 into account.

Figure 3:
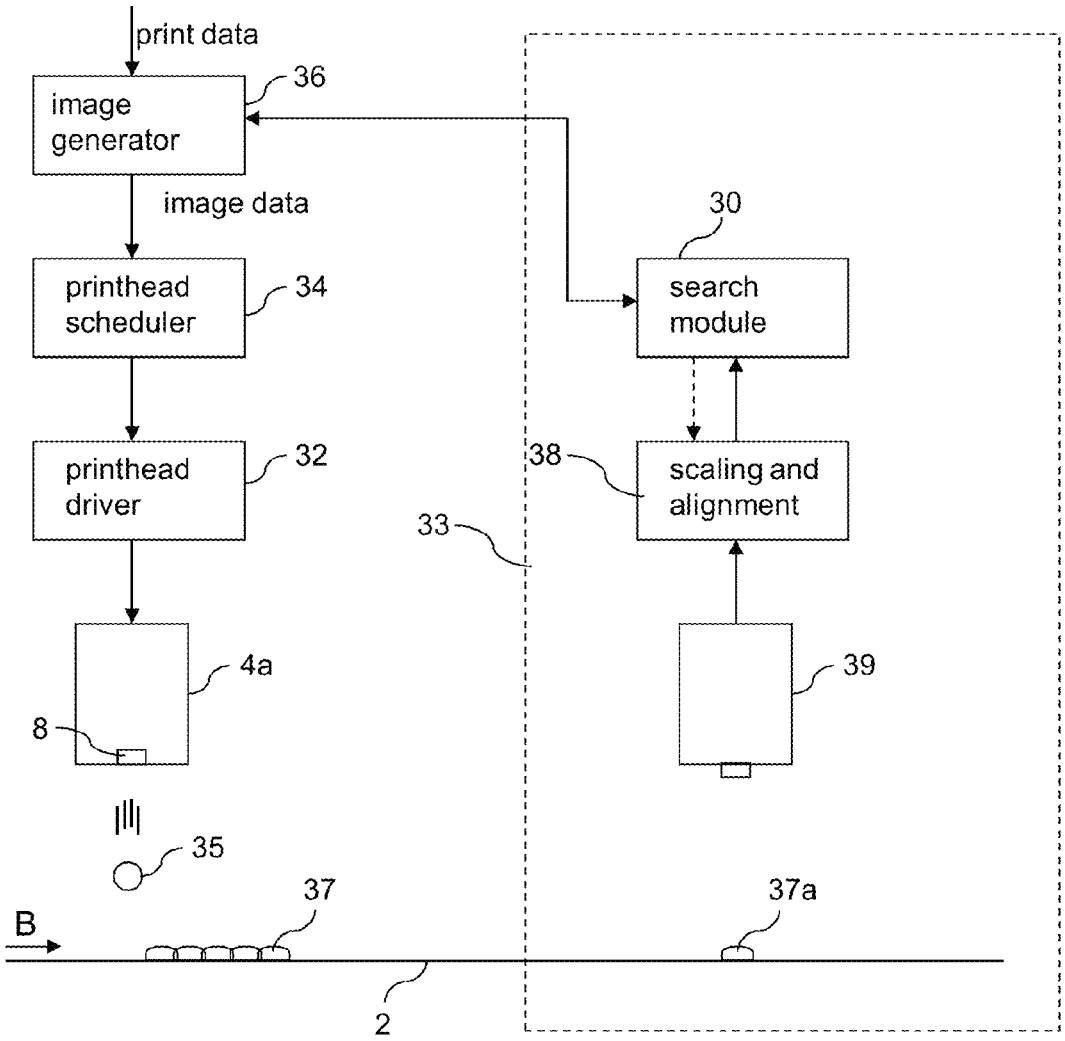
FIG. 3 is a schematic view of components of an inkjet printing assembly for executing the method according to the present invention.

FIG. 3 is a schematic view of the components of the inkjet printer that can be used for applying the method according to the present invention. The receiving material 2, e.g. at least one sheet of paper, is moved with a constant speed in the direction of the arrow B by means of a transport mechanism that has not been shown. The print head 4*a* having a plurality of nozzles 8 is disposed above the path of the receiving material 2 and extends over the entire width of the receiving material (in the direction normal to the plane of the drawing in FIG. 3). As is generally known in the art, the nozzles 8 have actuators configured to cause the nozzles to eject droplets 35 of marking material onto the receiving material 2 so as to print an image composed of dots 37 in accordance with print data supplied into the print head. The nozzles 8 are arranged in arrays of one or more lines across the width of the receiving material in a certain raster, which defines the print resolution, so that, within this raster, a dot 37 may be formed in any width wise location on the receiving material. The locations of the dots 37 on the receiving material in the medium transport direction B are determined by the timings with which the individual nozzles are fired when the receiving material 2 moves past the print head. In case of a color printer, in addition to the print head 4*a*, the other print heads will include a suitable array of nozzles 8 for other colors.

A scan operation part 33 for detecting a dot of a printed image is part of the inkjet printer. The scan operation part 33 comprises a scanner 39, which is disposed downstream of the print head 4*a* in the transport direction B and may be formed by a single-line (monochromatic) CCD-based or CMOS-based camera that also extends over the entire width of the receiving material 2. When the receiving material 2 moves past the scanner 39, the expected location of an ejected dot according to the printed image is scanned, so that the presence or absence of a dot according to the printed image on the location may be verified. In general, when a dot should have been printed at an expected location, but cannot be detected with the scanner 39, this indicates that there is a failing nozzle among the plurality of nozzles.

The resolution of the scanner 39 may be different from the resolution of the print head 4*a*. This is why the image recorded by the scanner 39 is sent to a scaling and alignment unit 38 where the resolution of the scanner 39 is matched with the resolution of the print head. A scaling and alignment unit 38 serves for correcting any possible misalignment between the print head and the scanner.

The scanned image that has been processed in the scaling and alignment unit 38 is forwarded to a search module 30, which also receives the image data generated by an image data generator 36. The search module 30 searches those areas in the scanned image where a dot 37*a* should be present according to the image data. When the dot 37*a* according to the image data is actually found, it is concluded that the nozzle that has printed this dot is still functioning. On the other hand, when no dot 37*a* according to the image data is found in the search area, it is concluded that the corresponding nozzle has failed, and a nozzle failure alarm is sent to the controller of the printer, so that the further method steps according to the present invention may be taken for camouflaging the nozzle failure and determining the appropriate compensation scheme for compensating the failing nozzle.

The scanned image that has been processed in the scaling and alignment unit 38 is forwarded to a search module 30, which also receives the image that is printed at the very moment. The search module 30 searches those areas in the scanned image where a dot 37*a* should be present according to the image. However, when the image to be printed contains solid areas in black (or any other color), where the dots 37 are directly adjacent to another and even partly overlap, the nozzle failure may create only a very small gap, which is difficult to detect with sufficient reliability. Moreover, even when such a gap is detected, it is difficult to decide which of the nozzles 8 is responsible for this gap, because even the scaling and alignment unit 38 will only be capable of correcting alignment errors with a certain accuracy.

Print data that specify the image to be printed are supplied to a print head driver 32, which causes the individual nozzles 8 of the print head to fire at appropriate timings. By way of example, it may be assumed that the nozzles 8 or their actuators are capable of firing synchronously with a certain frequency, so that a pixel line of dots 37 is formed on the receiving material 2 in each cycle. However, other printing strategies may be applied.

In the example shown, the print data are first supplied to the image data generator 36. This image data generator 36 determines an image of dots 37*a* that shall be printed on the receiving material 2. The print data are supplied to a print head scheduler 34, which specifies for each operating cycle of the print head 4*a* which of the nozzles 8 has to be actuated. The print head scheduler 34 will then send corresponding instructions to the print head driver 32. The print head scheduler 34 sends the information, on which nozzle 8 will fire or has fired at which time, to the image data generator 36. Instruction signals are sent from the print head scheduler 34 to the print head driver 32, so that the image that is actually printed with the print head 4*a* consists of an image specified by the print data.

The method according to the present invention will now be elucidated hereinafter with reference to FIGS. 4A, 4B, 5, 6A and 6B.

Figure 4A:
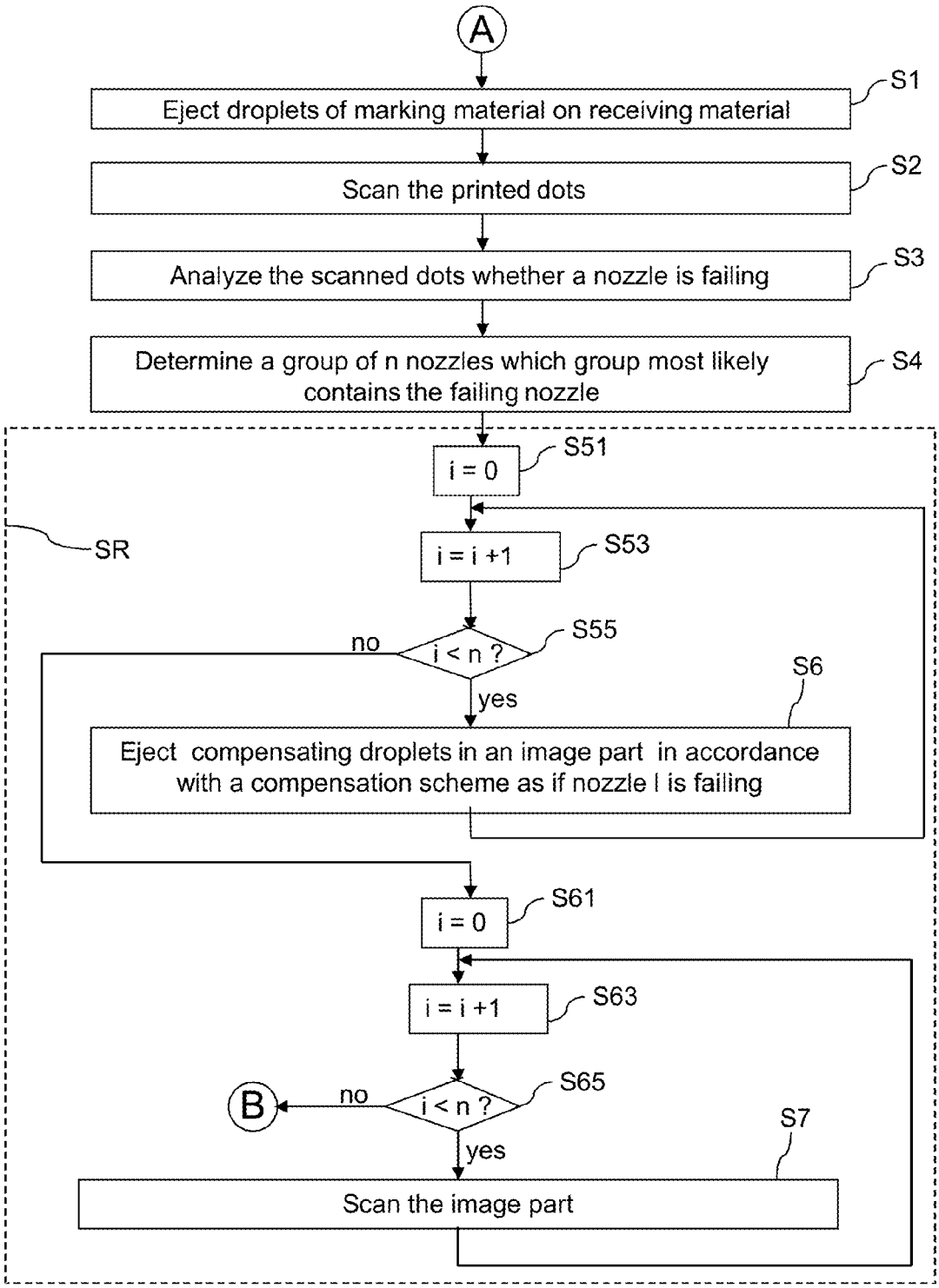
FIGS. 4A-4B are flow diagrams of an embodiment of the method according to the present invention.
Figure 4B:
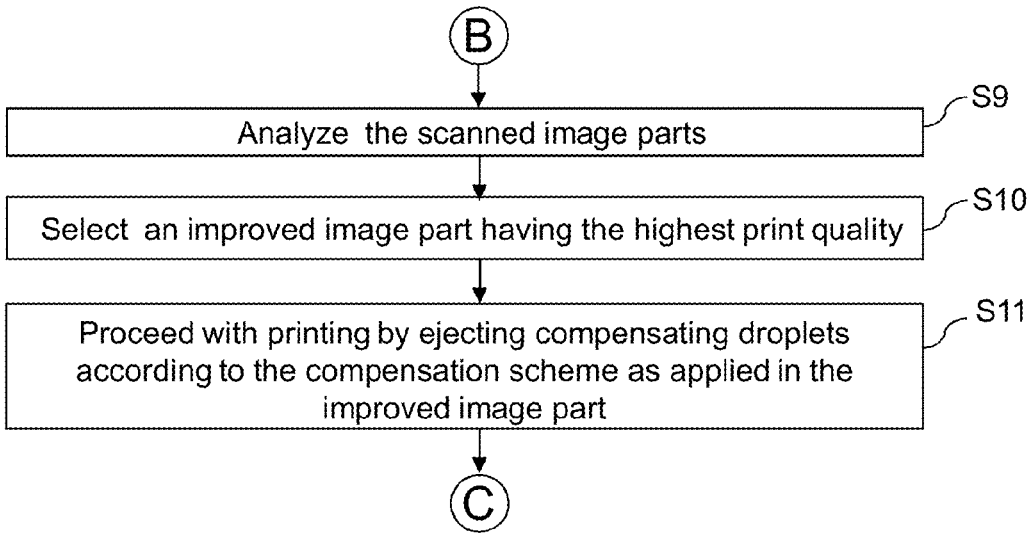

The method shown in FIG. 4A-4B starts at starting point A, which leads to a first step S1. According to the first step S1, droplets of marking material are ejected from the plurality of nozzles of the print unit onto the receiving material. The ejected droplets form dots of an image. According to a second step S2, the printed dots are scanned by the scan unit. According to a third step S3, the scanned dots are analyzed for detecting whether a nozzle is failing. The first three steps S1-S3 have already been elucidated here-above.

According to a fourth step S4, a group of nozzles is determined, which group of nozzles most likely contains the nozzle that is failing. In an example which is further illustrated in FIG. 5, the group of nozzles is a group of three neighboring nozzles D, E, F. However, the method according to the present invention is not limited to three nozzles and any natural number n of nozzles may be envisioned to apply the method according to the present invention. The number of nozzles may be neighboring or redundant. The nozzles D, E, F are going to eject droplets in three columns on the receiving material as illustrated in a planned portion 51 of the image. Since it is known that one of these nozzles D, E, F is failing, droplets to be ejected on the portion 51 will be changed according to a portion 52 of the image.

The planned portion 51 of the image is a portion where about 35% of the pixels have a droplet, i.e. the coverage of the planned portion 51 is about 35%. This is advantageous above image parts that have 0% coverage or 100% coverage. An image portion having a low variation of print data is preferred for applying the method according to the present invention.

Figure 5:
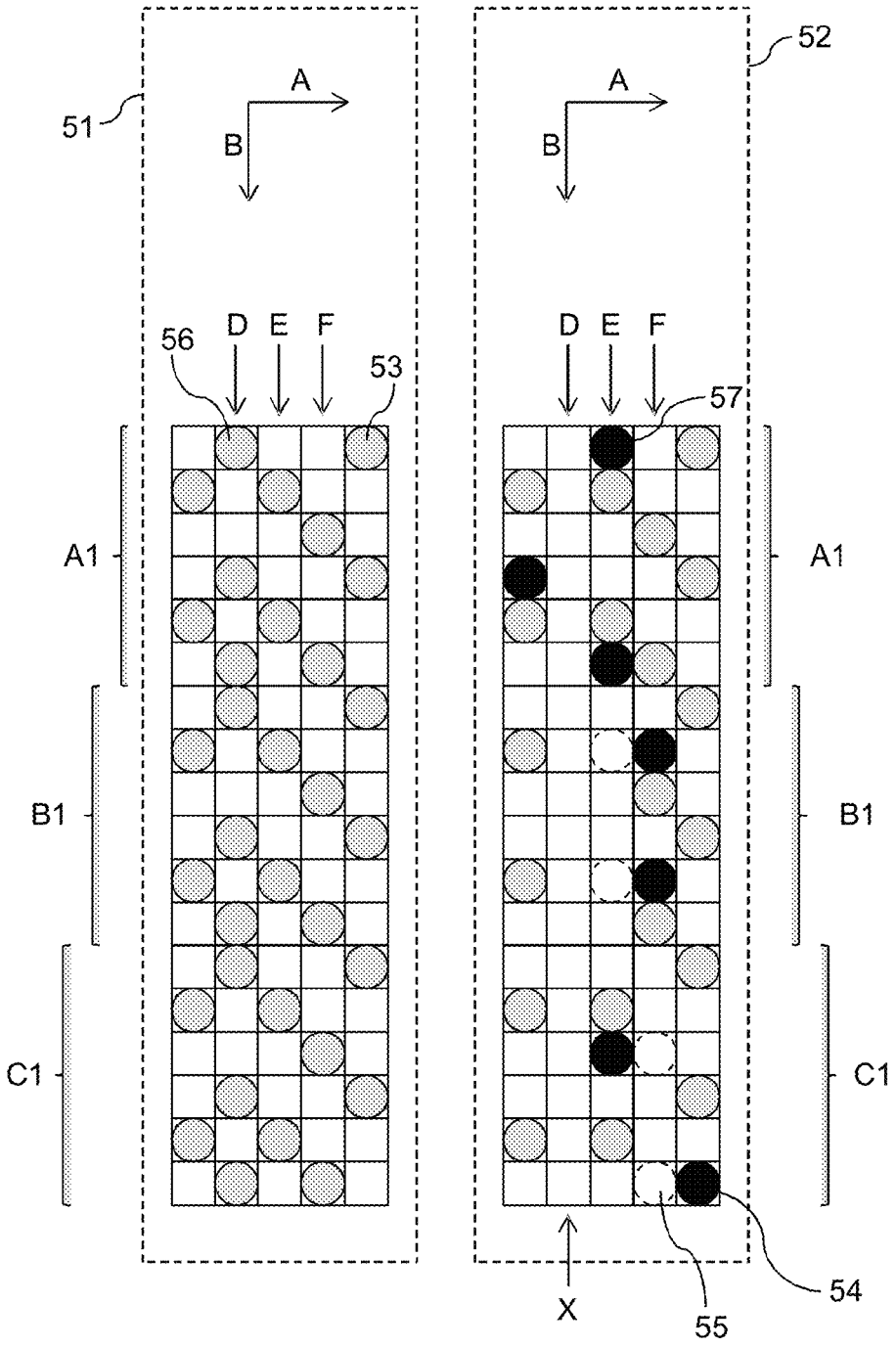
FIG. 5 is a schematic view of images printed according to the present invention while a nozzle is failing.

According to a fifth step S5, one nozzle of the group of nozzles is selected. In the example of FIG. 5, the nozzle indicated with the letter D is selected.

According to a sixth step S6, compensating droplets of marking material (the black colored dots) are ejected in an image part A1 in accordance with a compensation scheme selected as if nozzle D is failing. The compensating droplets are illustrated in amended portion 52 as black colored dots. At least one compensation scheme for compensating nozzle D is stored in memory of the controller of the inkjet printer. The image part A1 has a width of 5 pixels in the direction A and has a length of 6 pixels in the transport direction B. Since it is assumed that nozzle D is failing, the droplet 56 in the image part A1 of the planned portion 51 is compensated by a droplet 57 in the image part A1 of the amended portion 52. The amended portion 52 is printed by the inkjet printer.

According to a seventh step S7, the image part A1 of the amended portion 52 is scanned by the scan unit according to the previous description of the scanning process by the scan unit.

According to an eighth step, the sixth step S6 and the seventh step S7 are repeated for each other nozzle E, F in the group of nozzles.

Compensating droplets of marking material (black colored dots) are ejected in an image part B1 in accordance with a compensation scheme dedicated for nozzle E, i.e. the compensating droplets are ejected in the image part B1 in accordance with a compensation scheme as if nozzle E is failing. The image part B1 also has a width of 5 pixels in the direction A and has a length of 6 pixels in the transport direction B. The image part B1 is also scanned by the scan unit.

Compensating droplets 54 of marking material (black colored dots) are ejected in an image part C1 in accordance with a compensation scheme dedicated for nozzle F, i.e. the compensating droplets are ejected in the image part B1 in accordance with a compensation scheme as if nozzle E is failing. The image part C1 also has a width of 5 pixels in the direction A and has a length of 6 pixels in the transport direction B. The image part C1 is also scanned by the scan unit.

The sixth (printing) step S6 and the seventh (scanning) step S7 for each image part A1, B1, C1, may be ordered by first executing all sixth printing steps S6 and afterwards all seventh scanning steps S7, if the distance between the print head and the scan unit is large enough to contain all printed image parts A1, B1, C1. This will very often be the case, since the image parts A1, B1, C1 may be very small, for example 6 pixels long as in FIG. 5. The flow diagram of FIG. 4 describes this order of steps S5 and S6.

The method proceeds via point B to a ninth step S9 in FIG. 4B. According to the ninth step S9, each image part A1, B1, C1 is analyzed by the controller. The controller may have a dedicated image processing unit for analyzing image parts scanned by the scan unit. For example, an average coverage value of each image part A1, B1, C1 is established. The average coverage value of an image part A1, B1, C1 is a value that corresponds to the number of droplets that have actually been ejected onto the image part A1, B1, C1.

According to a tenth step S10, a deviating (improved) image part is selected from the image parts A1, B1, C1, which improved part has the highest print quality of all image parts A1, B1, C1. The print quality may be measured by looking at the average coverage value of the image parts A1, B1, C1. The image part A1 has the highest print quality, since it has a higher average coverage value than the other image parts B1, C1. Therefore the compensation scheme applied in the improved image part A1 is the most suitable for compensating for the failing nozzle. It is noted that for the image part A1, the compensating scheme has been applied assuming that nozzle D is failing. Since image part A1 is selected as the improved image part, it may be concluded that nozzle D was actually failing, and not the other nozzles E, F in the group of nozzles. The image portion 62 indeed shows a white column indicated by X where nozzle D was intended to have dropped droplets.

According to an eleventh step S11, the printing proceeds by ejecting compensating droplets according to the compensation scheme as applied in the improved image part A1. The method ends in end point C.

According to an embodiment, the steps in a dashed block SR may be repeated until an image portion 52 of image parts A1, B1, C1 on the receiving material reaches for the first time the scan unit. In this way, the receiving material printed upon in the time period between detecting that a nozzle is failing in the group of nozzles D, E, F and the application of the last eleventh step S11 of this method comprises droplets which partly (i.e. at least one third of the image parts A1, B1, C1) camouflage the not yet identified failing nozzle among the group of nozzles D, E, F. In case of a cut sheet inkjet printer, the steps S6-S8 may be repeated over more than one sheet of receiving material, if the method cannot be completed within one sheet. This depends on the distance between the print unit and the scan unit.

Figure 6A:
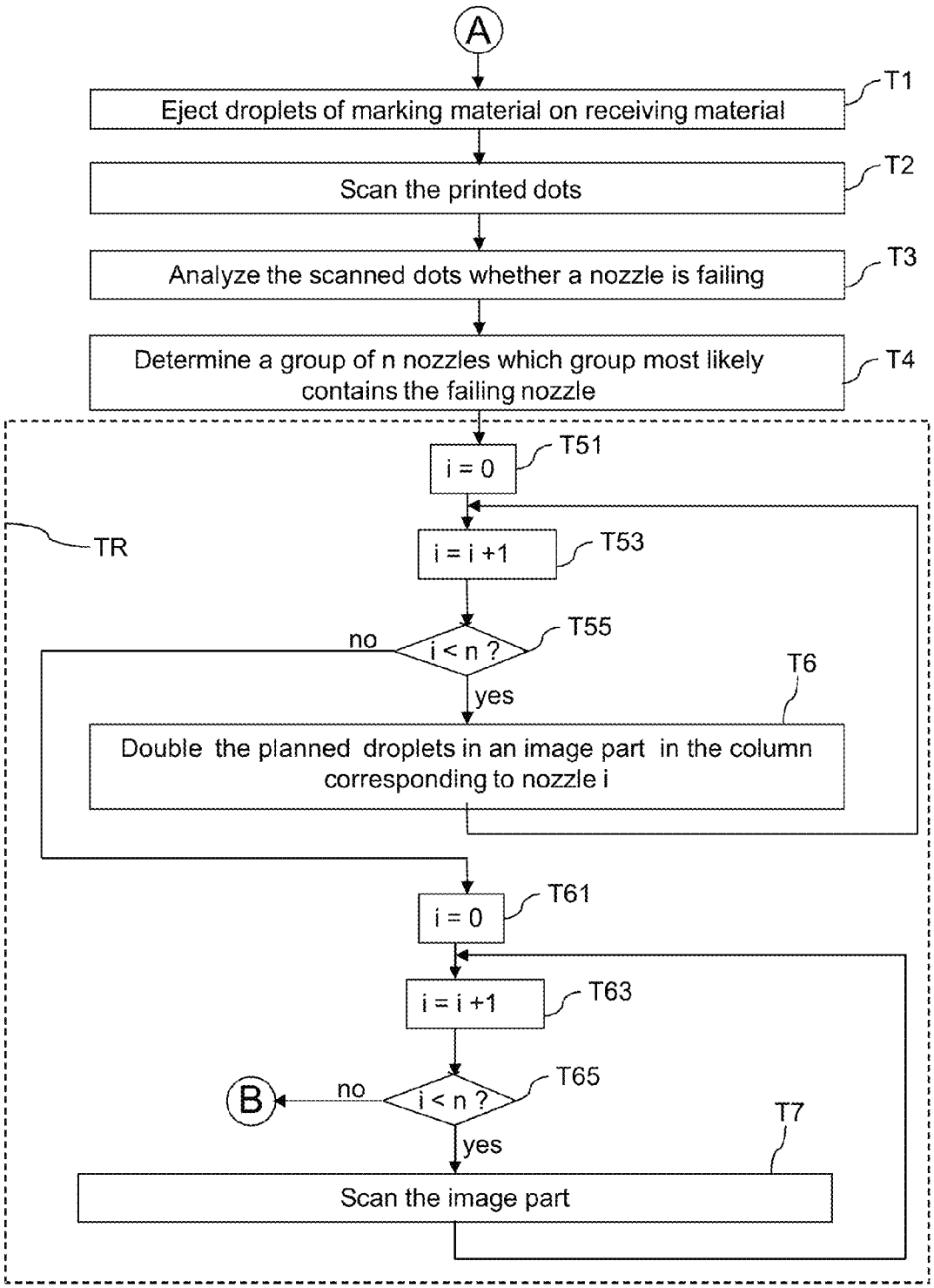
FIGS. 6A-6B are flow diagrams of a second embodiment of the method according to the present invention.
Figure 6B:
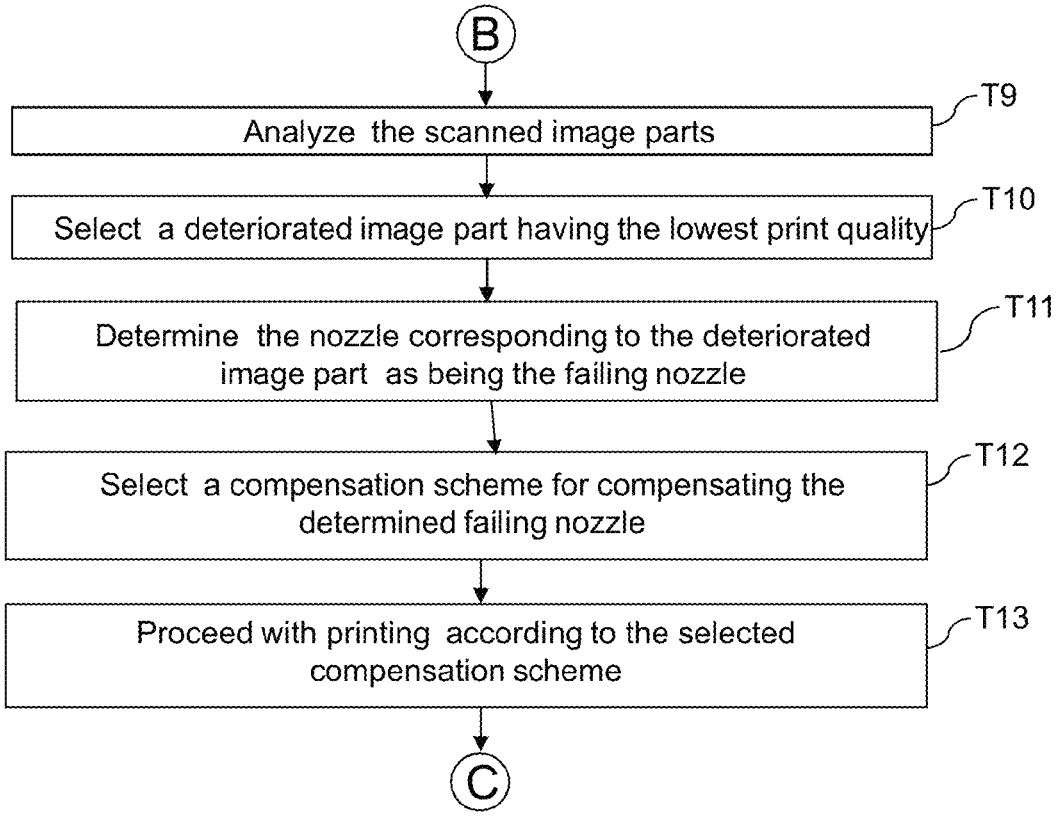
Figure 7:
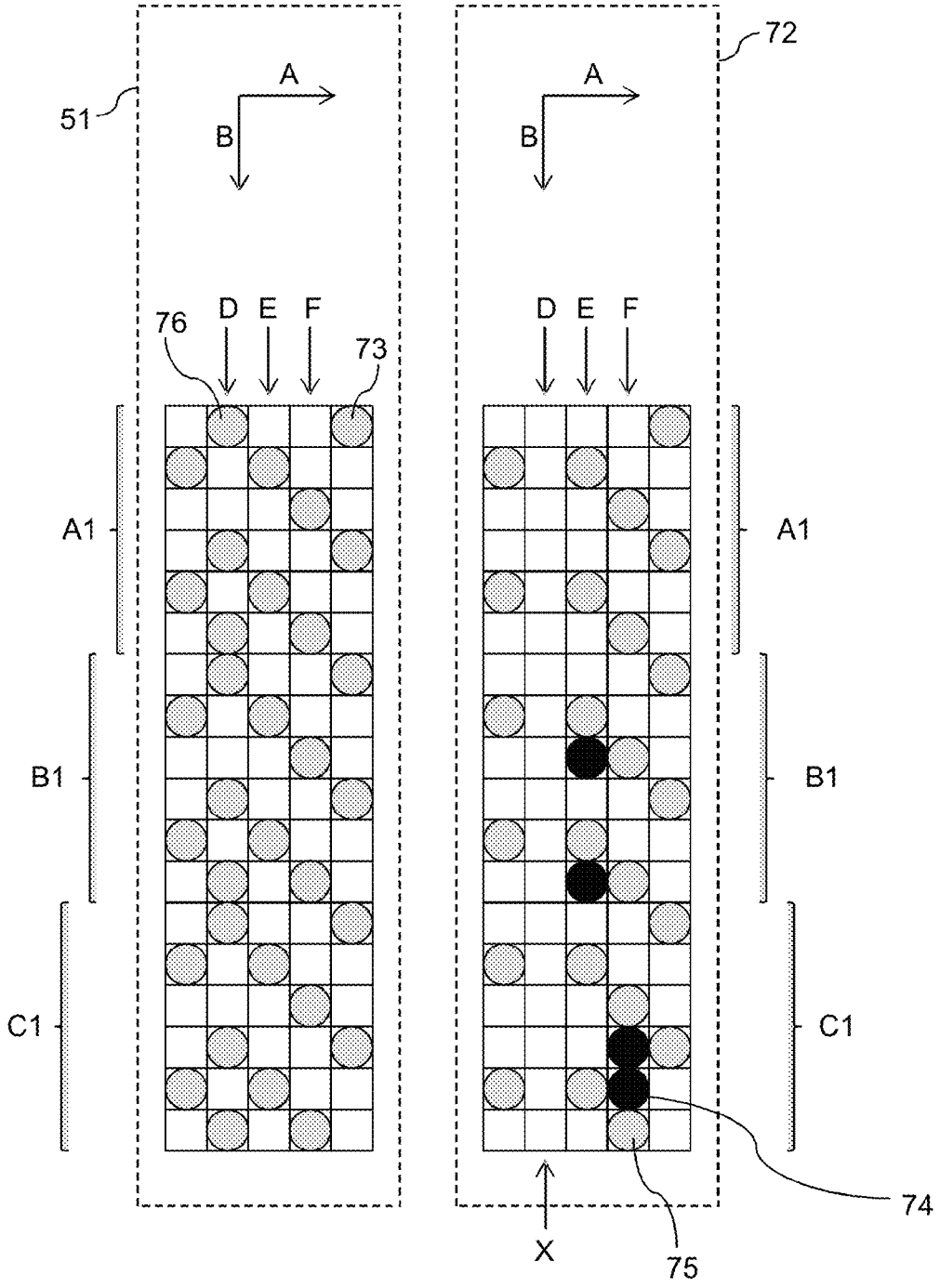
FIG. 7 is a schematic view of images printed according to the second embodiment while a nozzle is failing.

FIGS. 6A-6B illustrate a second embodiment of the method according to the present invention. The main idea is to subsequently increase the coverage of the image parts A1, B1, C1. The steps T1-T4 in FIG. 6A are equal to the steps S1-S4 in FIG. 4A. The steps in a block TR in FIG. 6A are equal to the steps in the block SR in FIG. 4A, with the exception that step S6 is different from step T6. The result of the steps in FIG. 6A-6B with respect to the printed image parts on the receiving material is shown in FIG. 7. In the example, which is further illustrated in FIG. 7, the group of nozzles is a group of three neighboring nozzles D, E, F. However, the method according to the present invention is not limited to three nozzles and any natural number n of nozzles may be envisioned to apply the method according to the present invention. The number of nozzles may be neighboring or redundant.

According to step T6, in the first image part A1, the coverage of the column droplets ejected by nozzle D is doubled. In the second image part B1, the coverage of the column droplets ejected by nozzle E is doubled. In the third image part C1, the coverage of the column droplets ejected by nozzle F is doubled. For example, a planned droplet 75 in image part C1 is doubled by adding the droplet 74 (black colored) to the planned droplets to be printed in image part C1. The extra droplets ejected by the doubling step T6 may be regarded as compensating droplets. By doubling the droplets in the image parts A1, B1, C1, the white stripe due to the failing nozzle will be partially compensated for in two of the three image parts A1, B1, C1.

This doubling of coverage of image parts is repeated until the correct compensating scheme is determined. When the printed image parts A1, B1, C1 are printed and scanned, the scanned image parts are analyzed in a next step T9. The analysis reveals that an average coverage of the printed image part A1 is lower than an average coverage of the other printed image parts B1, C1.

In an alternative embodiment of this method, the doubling of the coverage of the image parts is established by ejecting extra large droplets of marking material instead of doubling the originally planned droplets by means of additional droplets of marking material of the same size as the originally planned droplet size.

In a next step T10, the image part A1 is selected to be a deviating (deteriorated) image part having the lowest print quality. The print quality of the printed image part A1 is worse than the print quality of the printed image parts B1, C1. This lower coverage of the image part A1 indicates that nozzle D is failing and not one of the other nozzles E, F.

In a next step T11, the nozzle D corresponding to the deteriorated image part is identified as the failing nozzle. As the failing nozzle is identified, in a next step T12, an appropriate compensating scheme for compensating the failing nozzle D may be selected for application in further printing. Since nozzle D is the failing nozzle, a planned droplet 76 is not at the expected position in printed image portion 72 in contrast to a planned and ejected droplet 73.

In a next step T13, printing proceeds while applying the selected compensating scheme. This embodiment of the method ends in end point C.

In FIG. 5 as well as in FIG. 7, the second image part B1 could last longer in the transport direction of the receiving material to enable software to phase lock a position of the second image part B1. By doing so, it is known which scanned data belongs to which correction method. In an alternative embodiment, this knowledge is acquired by synchronizing the line pulses of the scan unit with the line pulses of the print head leading to a near perfect registration of the scan unit.

It is noted that a feedback loop is introduced between print unit, scan unit and controller. When a stripe is detected in the scanned image, the method according to the present invention is switched on by an image processing unit in the controller, the variation in image parts is introduced and a correct compensation scheme is selected for compensating the detected failing nozzle.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of compensating a failing nozzle of a print head of an inkjet printer, the inkjet printer comprising at least one print head, the at least one print head comprising a plurality of nozzles, wherein a receiving material is moved relative to the at least one print head, wherein the method comprises the steps of:

ejecting droplets of marking material from the plurality of nozzles onto the receiving material forming dots of an image;

scanning the printed dots;

analyzing the scanned dots for detecting whether a nozzle is failing;

determining a group of nozzles, which group of nozzles most likely contains the nozzle that is failing;

selecting one nozzle of the group of nozzles;

in an image part, ejecting compensating droplets of marking material in accordance with a compensation scheme selected as if said one nozzle is failing;

scanning the image part;

repeating the steps of ejecting and scanning for each other nozzle in the group of nozzles;

analyzing each image part;

selecting from the image parts a deviating image part with respect to print quality, the deviating image part having a highest or lowest print quality of all image parts;

selecting a compensation scheme based on the deviating image part; and proceeding with printing, including ejecting compensating droplets in accordance with the selected compensation scheme, wherein each image part has such a size in the direction of the movement of the receiving material that variations in the printed dots on the image parts are not or slightly visible to an observer but are detectable while scanning the image parts, and wherein the method further comprises the step of printing the image parts before any of the image parts are scanned.

2. The method according to claim 1, wherein the size in the direction of the movement of the receiving material is six pixels.

3. The method according to claim 1, wherein the method further comprises the step of repeating the ejection of compensating droplets for the image parts until printing proceeds, including ejecting compensating droplets in accordance with the compensating scheme based on the deviating image part.

4. The method according to claim 3, wherein the method further comprises the step of selecting from all image parts a number of image parts having a low variation of print data, said number being sufficient to select the deviating image part.

5. The method according to claim 1, wherein the method further comprises the step of identifying a nozzle uniquely corresponding to the deviating image part as the failing nozzle.

6. The method according to claim 1, wherein the method further comprises the step of ejecting regular droplets of marking material needed for the image from said one nozzle, which one nozzle is assumed to be failing, in addition to ejecting the compensating droplets.

7. The method according to claim 1, wherein the method comprises the step of, for each image part, doubling a coverage of the compensating droplets.

8. The method according to claim 7, wherein the step of doubling the coverage of the compensating droplets for each image part comprises the step of increasing the size of the compensating droplets.

9. An inkjet printer comprising:

a print head having a plurality of nozzles, wherein a receiving material is moved relative to the print head and droplets of marking material are ejected from the nozzles onto the receiving material in order to form an image of dots on the receiving material;

a scanner configured to scan printed dots; and a controller configured to schedule compensation schemes during printing of the image in order to apply the method according to claim 1.

10. The inkjet printer according to claim 9, wherein a distance between the print head and the scanner is large enough to contain the image parts in the direction of the movement of the receiving material and the image parts are printed before any of the image parts is scanned.

* * * * *